US005415381A

United States Patent [19]

Beiletti et al.

[11] Patent Number: 5,415,381

[45] Date of Patent: May 16, 1995

[54] STEEL BAR AND BILLET HEATING SYSTEM LOCATED UPSTREAM OF SHEARS FOR FURTHER PROCESSING

[75] Inventors: Guido Beiletti, Grugliasco; Giovanni Bernardi; Pier Angelo Dell'Oca, both of Turin, all of Italy

[73] Assignee: Elind, S.p.A., Italy

[21] Appl. No.: 859,297

[22] PCT Filed: Nov. 23, 1990

[86] PCT No.: PCT/IT90/00098

§ 371 Date: Jul. 17, 1992

§ 102(e) Date: Jul. 17, 1992

[87] PCT Pub. No.: WO91/08089

PCT Pub. Date: Jun. 13, 1991

[30] Foreign Application Priority Data

Nov. 24, 1989 [IT] Italy ..... 22506/89

[51] Int. Cl.[6] ..... C21D 1/34

[52] U.S. Cl. ..... 266/87; 266/96

[58] Field of Search ..... 266/91, 87, 78, 96, 266/103, 104

[56] References Cited

U.S. PATENT DOCUMENTS 4,373,364 2/1983 Tanimoto et al. ..... 266/87

4,606,529 8/1986 Tooch ..... 266/87

*Primary Examiner*—Scott Kastler

*Attorney, Agent, or Firm*—Panitch Schwarze Jacobs & Nadel

[57] ABSTRACT

A steel bar and billet heating system located upstream of shears for further processing comprises a conventional fuel operated heating furnace up to a material temperature of 780°–1000° C., followed by at least two subsequent individual induction heating stations up to the shearing or hot-pressing temperature of 1150°–1300° C. The system further comprises induction furnace monitoring and thermal control means, product forwarding means within the combustion furnace and from the latter to the shears through the induction furnaces, adapted as well to move the bars and billets backwards, in the opposite direction, there being provided a waiting area inside the furnace, a loader for the slugs coming back from the shears, and means for traversing the latter so that they do not interfere with the path of the pieces.

10 Claims, 2 Drawing Sheets

STEEL BAR AND BILLET HEATING SYSTEM LOCATED UPSTREAM OF SHEARS FOR FURTHER PROCESSING

FIELD OF THE INVENTION

This invention concerns a steel bar and billet heating system located upstream of shears for further processing, in particular hot-pressing.

BACKGROUND OF THE INVENTION

It is known that a very large majority of pieces derived from steel bars and billets is obtained by press-forging, after shearing, and preferably by hot-pressing at temperatures of 1100°–1300° C. In such a way it is possible to reach satisfactory results, not only cost-wise, but also concerning the quality of the finished product, compared to cold processing both on a machine tool and through shearing and pressing at temperatures lower than 1100° C.

It is also known that, for heating steel bars and billets stocked at ambient temperature, to the above mentioned temperatures, up to now use has been made of combustion furnaces or induction furnaces. In the former (also in chronological terms) liquid or gaseous hydrocarbons (presently methane is preferred) are used to generate heat. Heat transfer to the products forwarded therewithin, for instance by means of pilger rolls or beams, takes place by radiation from the ceiling and from the walls of said furnace wherein the products are introduced through the front or through the sides, and are retained for a predetermined time span, so that they reach, at the exit therefrom, the predetermined temperature. If the latter has to reach values of 1150°–1300° C. for hot-pressing, as it has been mentioned above, very thick and expensive refractory linings must be provided, which strongly increase the furnace thermal inertia whereby, when the furnace requires maintenance operations, rather frequent at said high temperature levels, very long waiting times are needed for cooling, in the order of several days, during which production has to be stopped. A further problem taking place when combustion furnaces are used to reach the hot-pressing temperature directly, besides the fact that the energy performance drops considerably above a certain temperature, is due to the strong oxidation and associated formation of surface scale taking place on the products in particular due to the long high temperature residence times which cause as well the problem of a possible material decarburizing. It should further be noted that these times are further increased when, for any reason like a shears failure, forwarding of the pieces is interrupted.

On the other hand, also the usage of the induction furnaces alone to reach hot-pressing temperatures starting from ambient temperatures causes some important drawbacks, like the fact that furnaces having such performance are necessarily expensive, although they provide some advantages like the fact that the furnace goes almost immediately to rated conditions with an optimum thermal control capacity, reduction of scale owing to the shortened high temperature residence time, as well as the reduced maintenance requirements with an associated shortening of the operation downtimes.

One of the reasons why use of the induction furnaces has not developed in proportion to what the advantages mentioned above would suggest, besides the costs recalled above, is the fact that steel has a Curie temperature level around 760° C., above which a ferromagnetic material becomes a magnetic, whereby the relative magnetic permeability value ($\mu r$) becomes equal to 1. Therefore, there takes place a substantial heating inductor performance reduction in that the power transferred to the piece to be heated is given by the following formula:

$$Pw = \mu o \times \mu r \times \pi \times F \times H^2 \times V \times K$$

wherein:

Pw = power transferred to the piece located within the heating inductor;

$\mu o$ = absolute permeability of air = $4\pi \times 10^{-7}$;

$\mu r$ = relative permeability = average value 20 below the Curie temperature;.

F = working frequency in Hz;

H = magnetic field intensity in Asp/m;

V = volume of the piece to be heated;

K = a function of the ratio between diameter of the piece and current penetration depth inside the piece.

The inductor performance may also be defined through the following formula:

$$\eta = \frac{1}{1 + \sqrt{\frac{\rho c}{\rho w} \times \frac{1}{\mu r}}}$$

wherein:

$\eta$ = inductor performance;

$\rho c$ = resistivity of the inductor material = $0{,}017 \times 10^{-6} \Omega \times m$;

$\rho W$ = resistivity of the piece being heated. In the case of a 0,23% carbon steel we have a value at 20° C. of $0{,}160 \times 10^{-6} \Omega \times m$; a value at 1200° C. of: $1{,}22 \times 10^{-6} \Omega \times m$;

$\mu r$ = relative permeability = average value 20 below the Curie temperature.

Therefore, it would seem to be preferable to use induction furnaces only for heating to a level below the Curie temperature. If it were necessary to reach higher temperatures a combustion furnace should be used. Therefore, it would seem to be advisable to use induction furnaces until the Curie temperature is reached, passing then to a combustion furnace.

On the contrary FR-A-2,284,847 discloses a steel bar and billet heating system for further processing, which provides an initial heating, from ambient temperature up to 700° C. in a combustion furnace, followed by heating up to 1200°–1250° C. in induction furnaces. Also "Steel in the USSR", Vol 12 No. 3 March 1982, London (pages 131–133) shows a similar system wherein the combustion furnace is used for heating up to 750°–800° C. and an electric heating up to the temperature of plastic working.

From U.S. Pat. No. 4,559,854 a shearing equipment is known in which induction furnaces are located immediately before the shears and a roller path is provided between the induction furnaces for forwarding the bars and billets towards said shears.

SUMMARY OF THE INVENTION

Briefly stated, the present invention is for a steel bar and billet heating system located upstream of shears, wherein the shears work at temperatures of 1100°–1300°

C. The system comprises a heating combustion furnace having means for forwarding the bars and billets therewithin in a first direction towards a furnace unloading roller table. The combustion furnace performs an initial heating from ambient temperature up to a temperature of 780°-1000° C. At least two induction furnaces arranged in series with each other and located downstream of the combustion furnace and immediately before the shears are provided for heating up to 1150°-1300° C. A roller path is located between the exit from the combustion furnace and the induction furnaces for forwarding the pieces towards the shears. Each induction furnace includes a pyrometer located immediately ahead of each induction furnace for detecting the inlet temperature to each of the induction furnaces and for controlling the operation thereof in order to reach a respective predetermined exit temperature from each of the induction furnaces. An additional pyrometer is located at the exit from the last induction furnace for monitoring the final processing temperature.

BRIEF DESCRIPTION OF THE DRAWINGS

The above and other objects, advantages and features of the system according to this invention will become apparent to those skilled in this art from the following detailed description of a preferred embodiment thereof, made for exemplary and non limiting purposes, in reference to the attached drawings, wherein.

DESCRIPTION OF THE PREFERRED EMBODIMENT

Figure 1:
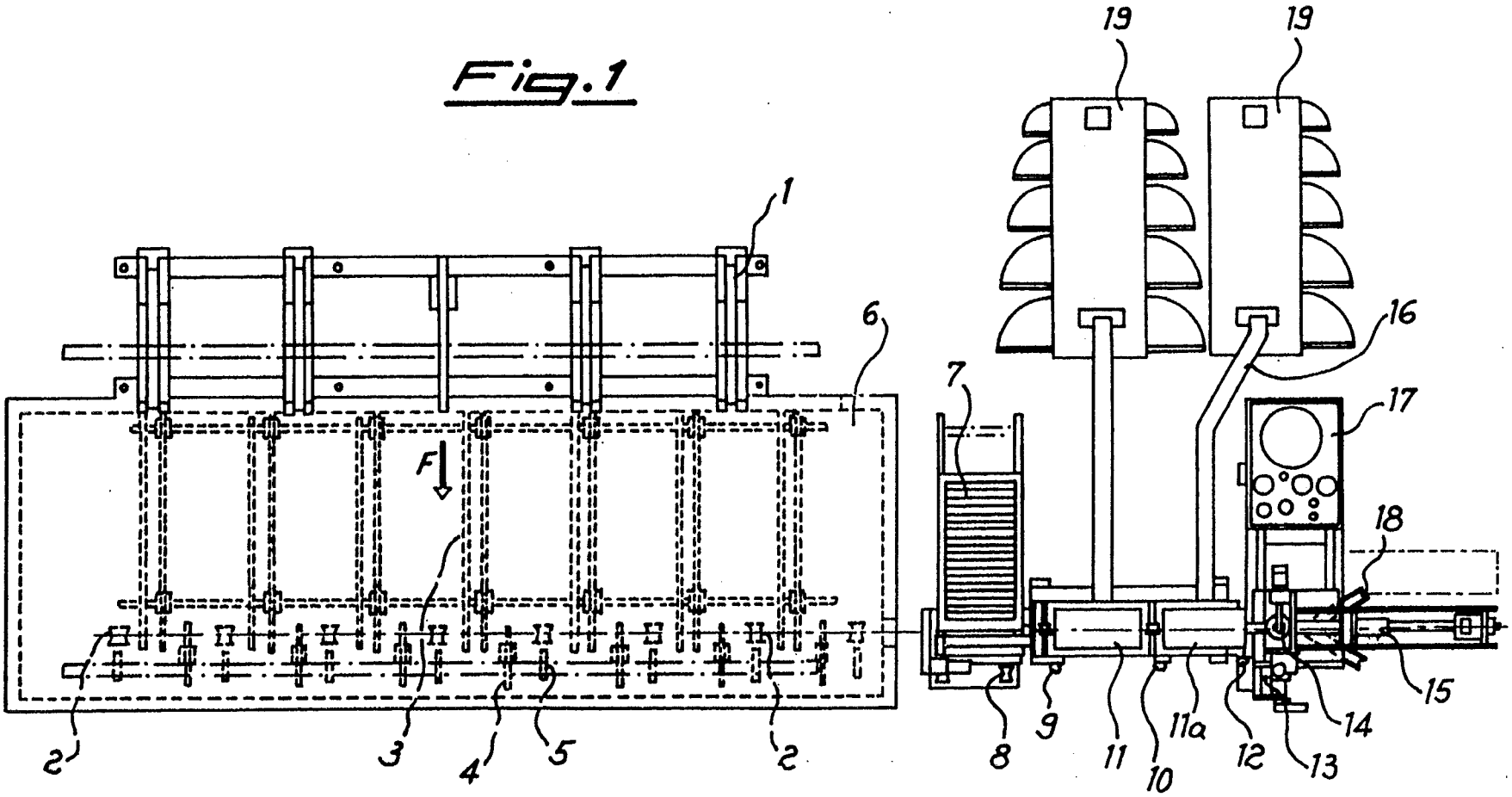
FIG. 1 shows a general schematic plan view of the system according to this invention.

Referring now to the drawings, the system according to this invention includes, at the entrance to a combustion furnace 6, preferably a gas type furnace, an automatic bar selector 1 for front loading of the furnace, which might of course also be provided in the side loading type with an intake roller table on the left hand side of the Figure. Furnace 6 within which the bars are forwarded in the direction of arrow F, for instance by means of a pilger process bar forwarding assembly whose driving members have been schematically shown and indicated by reference number 3, provides progressive heating of the metal products therewithin until, at the exit, the latter reach a temperature of 780°-1000° C., ranging preferably between 800° and 850° C., for reasons of energy saving and of surface scale reduction. In the exit area the bars or billets are withdrawn by an evacuating roller table 2 and they are forwarded longitudinally out of the furnace in alignment with an outer roller table 8 connecting the gas furnace with the induction furnaces. The latter have been indicated with reference numbers 11, **11*a* and are connected, for instance through bus bars 16 with medium frequency generators 19** in order to produce heating, inside the metal products forwarded therethrough, up to a temperature of 1250°-1300° C.

Optical pyrometers 9, 10 and 12 are provided for temperature monitoring respectively at the exit of furnace 6, at the exit of first inductor 11 and of second inductor **11*a*, whereby pyrometer 9 determines a first control on furnace 11 and pyrometer 10 determines in real time a final control of furnace 11*a*, in such a way as to make sure that the product comes out of the latter at the desired temperature. Pyrometer 12** monitors the piece final temperature, i.e. the process temperature. Of course more than two induction furnaces may be provided for a finer and more reliable control.

Figure 3:
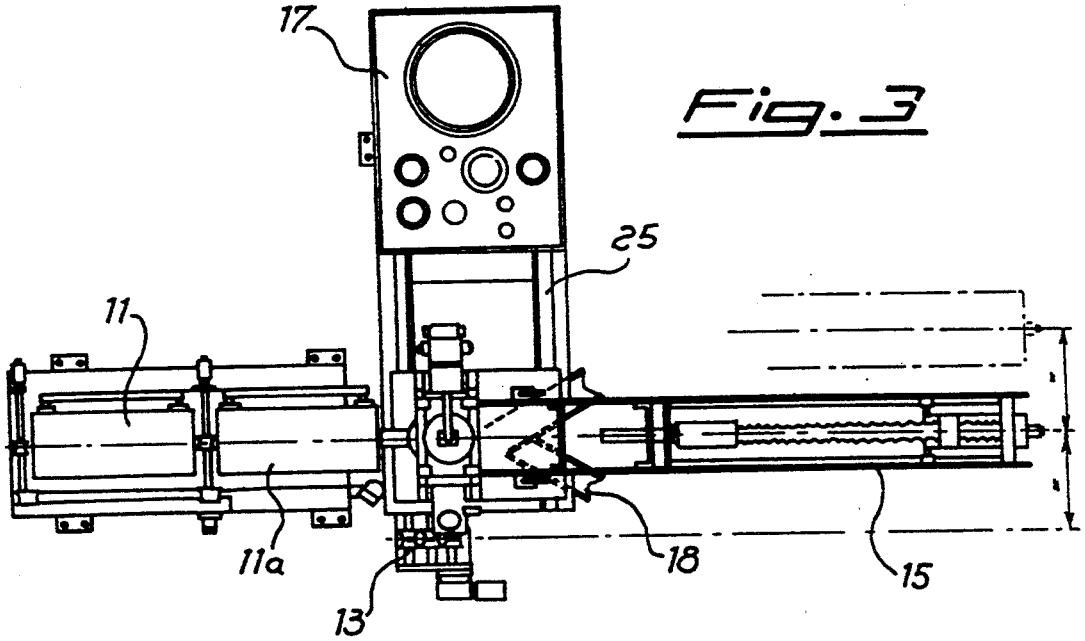
FIG. 3 is a top plan view of the same portion of the system shown in FIG. 2.
Figure 2:
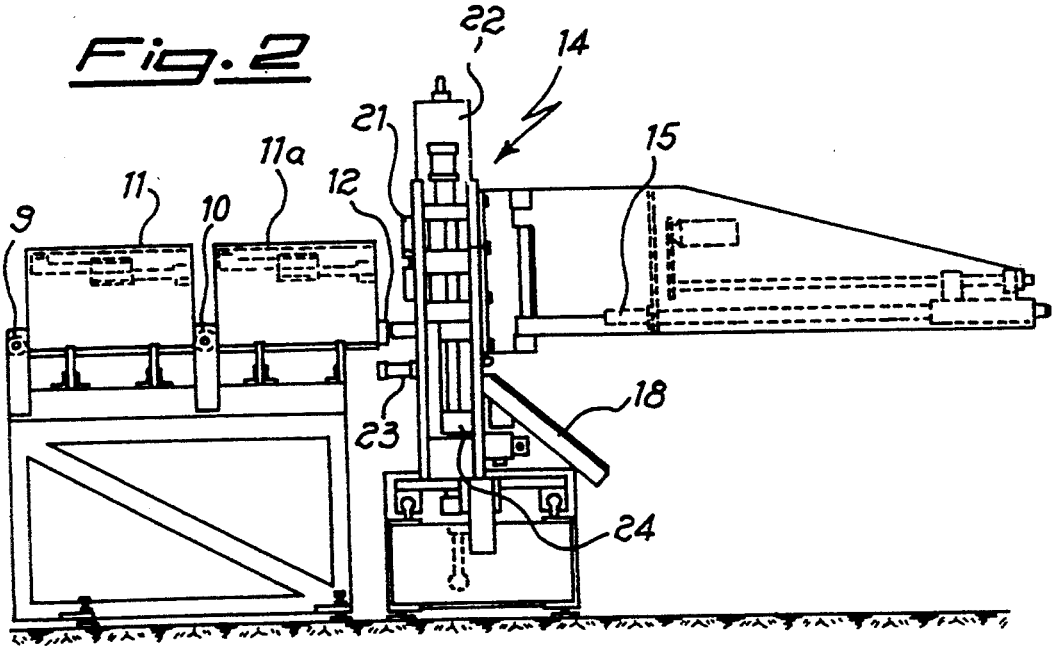
FIG. 2 shows a more detailed elevational view of the part of the system including the shears.

Shears 14, which are controlled by a conventional hydraulic control center 17 and are possibly provided, in a way known, with an entrance bar-holder group 21, with a bar shearing hydraulic cylinder 22, and with a square-cut cylinder 24, have an outlet motor driven front stopper 15 and a preferably three-way unloading chute 18 where the cut pieces come out from. According to a particular feature of this invention, shears 14 are mounted on slide rails 25, as it is best shown in FIG. 3, in order to be able to traverse them and in any way to move them apart from the piece forwarding path whereby, in case some sheared slugs, for any reason, are not used downstream of the shears, they may be moved backwards, for being heated once more in view of further processing, and may be recovered and stocked inside a so called "louvers type" elevator loader 7. At the furnace exit there is provided a fast roller unloader 13 adapted to unload the slugs and avoid interference with the shears. In fact, when the shears will have moved to the position shown by a chain line in FIGS. 1 and 3, the roller unloader 13 will be able to withdraw the sheared slugs in that it is axially aligned with the shearing area (see FIG. 3).

In the same way, in case of a failure or any machine stoppage of shears 14, the bars or billets which have already been forwarded all the way to the induction furnaces 11 and **11*a* may be moved backwards, through a reverse motion of roller conveyor 8, until they come back inside furnace 6, wherein they may be kept heated in view of a following manufacturing process resumption. Of course, unloading roller table 2 of furnace 6 is taken by the bars and billets already heated and ready to come out. In order to allow the bars already forwarded out to go back inside furnace 6 there is provided, within furnace 6, a waiting area 5 where the bars present on the unloading roller table 2 are transferred, for instance by means of overturning levers 4 adapted to free said roller table by moving the bars and billets located thereon towards said waiting area 5 which may be located, as shown in FIG. 1, opposite said roller table relative to the product forwarding direction within furnace 6**, in the direction of arrow F.

Additions and/or modifications may possibly be made by those skilled in this art to the embodimental form, described and shown herein above, of the system according to this invention, without exceeding the scope of said invention.

We claim:

1. A steel bar and billet heating system located upstream of shears, wherein the shears work at temperatures of 1100°-1300° C., comprising:

a heating combustion furnace provided with means for forwarding said bars and billets therewithin, in a first direction towards a furnace unloading roller table said combustion furnace performing an initial heating from ambient temperature up to a temperature of 780°-1000° C.;

at least two induction furnaces arranged in series with each other and located downstream of said combustion furnace and immediately before said shears for heating said bars and billets up to 1150°-1300° C.;

a roller path between the exit from said combustion furnace and said induction furnaces operable in the first direction, for forwarding towards the shears, wherein said roller path is also operable in a second direction, opposite to the first direction when the shears are stopped so that bars and billets located on said roller path between said combustion furnace and the shears can re-enter said combustion furnace, wherein each induction furnace includes a pyrometer located immediately ahead of each induction furnace for detecting the temperature of said bars and billets prior to entering each of said induction furnaces and for controlling the temperature of said bars and billets when exiting said induction furnaces; and a pyrometer located at the exit from the last induction furnace for monitoring the final processing temperature of said bars and billets.

2. The system of claim 1 wherein a waiting area is provided within said combustion furnace for temporarily stocking the bars and billets located on the roller table close to the exit from said combustion furnace, in order to enable other bars and billets already forwarded out of said combustion furnace to re-enter said combustion furnace following operation of the roller path in said second direction.

3. The system of claim 2, further comprising means for moving said roller path in said second direction, said means comprising overturning levers.

4. A system according to claim 11 further comprising means for withdrawing from the shears slugs which have not been used in a working cycle for reheating said slugs in further manufacturing process, and means for stocking said unused slugs.

5. The system of claim 4, wherein said shears are mounted on horizontal rails in order to be moved apart from the path of the slugs so that the slugs can go back upstream.

6. The system of claim 4, wherein said means for stocking the unused slugs coming back from the shears comprise an elevator loader.

7. A steel bar and billet heating system located upstream of shears, wherein the shears work at temperatures of 1100°–1300° C., comprising:

a heating combustion furnace having means for forwarding said bars and billets therewithin, in a first direction towards a furnace unloading roller table, said combustion furnace performing an initial heating of said bars and billets from ambient temperature up to a temperature of 780°–1000° C.;

at least two induction furnaces arranged in series with each other and located between said combustion furnace and said shears for heating said bars and billets up to 1150°–1300° C.; and a roller path between an exit from said combustion furnace and an entrance to said induction furnaces, said roller path operable in the first direction for forwarding the bars and billets towards the shears, and operable in a second direction, opposite said first direction, for allowing said bars and billets to re-enter said combustion furnace when said shears are stopped.

8. The system of claim 7 further comprising a pyrometer located proximate the entrance to each of the induction furnaces for detecting the temperature of the bars and billets prior to the bars and billets entering each of said induction furnaces and for controlling the operation thereof; and a pyrometer located proximate the exit from the last induction furnace for monitoring the final processing temperature.

9. The system of claim 8, wherein said shears are mounted on horizontal rails for withdrawing from said shears slugs which have not been used in a working cycle so that said slugs can be reheated.

10. A steel bar and billet heating system located upstream of shears, wherein the shears work at temperatures of 1100°–1300° C., comprising:

a heating combustion furnace having means for forwarding said bars and billets therewithin in a first direction towards a furnace unloading roller table, said combustion furnace performing an initial heating of said bars and billets from ambient temperature up to a temperature of 780°–1000° C.;

at least two induction furnaces arranged in series with each other and located between said combustion furnace and said shears for heating said bars and billets up to 1150°–1300° C., each of said induction furnaces having a pyrometer located proximate an entrance thereto for detecting the inlet temperature of the bars and billets and for controlling the operation thereof;

an exit pyrometer located proximate the exit of the last induction furnace for monitoring the final processing temperature of the bars and billets;

a roller path between said combustion furnace exit and an entrance to said induction furnaces, said roller path operable in the first direction for forwarding the bars and billets towards the shears, and operable in a second direction, opposite said first direction, for allowing said bars and billets to re-enter said combustion furnace when said shears are stopped, wherein a waiting area is provided within said combustion furnace for temporarily stocking the bars and billets therewithin;

means for withdrawing slugs from the shears which have not been used in a working cycle so that said slugs can be reheated; and means for stocking said unused slugs.

* * * * *